US005249315A

United States Patent [19]

Moylan

[11] Patent Number: 5,249,315

[45] Date of Patent: Oct. 5, 1993

[54] TUB GUARD AND EXTENSION

[76] Inventor: Sandra K. Moylan, 9 Aghworth Ave., North Oxford, Mass. 01537

[21] Appl. No.: 729,494

[22] Filed: Jul. 12, 1991

[51] Int. Cl.[5] ..... A47K 3/14

[52] U.S. Cl. ..... 4/559; 4/577.1

[58] Field of Search ..... 4/557, 558, 559, 607, 4/608, 609, 576, 577, 546, 548, 504, 580, 658, DIG. 18, 600, 599; D23/303-310; D6/524; 5/425, 427, 428

[56] References Cited

U.S. PATENT DOCUMENTS

| | | | |
|---|---|---|---|
| D. 189,906 | 3/1961 | Best et al. | 4/576.1 X |
| 1,159,507 | 11/1915 | Lang | 4/558 |
| 1,367,290 | 2/1921 | Williams | 4/559 X |
| 1,791,696 | 2/1931 | Alexander | 4/609 |
| 2,254,004 | 8/1941 | De Puy | 4/546 |
| 2,725,576 | 12/1955 | Schwersinske | 4/609 |
| 2,736,904 | 3/1956 | Suggs | 4/577.1 |
| 2,836,834 | 6/1958 | Tisdall | 4/577.1 |
| 2,885,690 | 5/1959 | Scott | 4/576.1 |
| 2,931,051 | 4/1960 | Sparling | D6/524 X |
| 3,448,468 | 6/1969 | Murcott | 4/577.1 |
| 4,370,765 | 2/1983 | Webber | 5/427 |
| 4,827,545 | 5/1989 | Arp | 5/425 X |

FOREIGN PATENT DOCUMENTS

| | | | |
|---|---|---|---|
| 3434955 | 3/1986 | Fed. Rep. of Germany | 5/427 |
| 0883435 | 11/1961 | United Kingdom | 4/558 |
| 2136280 | 9/1984 | United Kingdom | 5/427 |

*Primary Examiner*—William A. Cuchlinski, Jr.
*Assistant Examiner*—John L. Beres
*Attorney, Agent, or Firm*—James F. Baird

[57] ABSTRACT

The disclosed apparatus is a safety device preventing a toddler from entering a bathtub. The apparatus provides an obstruction to a child comprising netting stretched across the entry side of the tub supported by tubing. The netting and tubing are in turn supported by horseshoe shaped clamps that are secured to the upper entry lip of the tub by suction cups. In addition, the horizontal ends of the tubing may be secured to the tub enclosure walls by suction cups. The tubing may be presized to fit specific tub dimensions or adjustable to be used with tubs with a variety of dimensions. For tubs that have an end (or ends) that are not enclosed by a wall, an extension is available incorporating similar netting and tubing and horseshoe shaped clamp together with suction cups to secure the extension to the tub and wall.

4 Claims, 4 Drawing Sheets

TUB GUARD AND EXTENSION

BACKGROUND OF THE INVENTION

My invention would be recognized as a child safety device, protecting and or guarding the toddler or infant from entering the bathtub. My main objective is to mentally condition the minds of the infant or toddler from becoming accustomed to entering into the bathtub without supervision. The invention is to keep the toddle or infant from falling into the tub thus avoiding any type of head trauma and or physical injury. Assessing and monitoring infant and toddler activity, it is apparent that they are psychologically very curious when exploring. Their sensory motor function is automatically turned on as they approach an area of interest. Whether they see a dripping faucet, or an object sighted near the edge or in the tub, their response is to investigate. The nature of my invention would be to discourage the toddler or infant from entering the bathtub, again avoiding physical trauma, possibly permanent, and drowning if water is present.

This tub guard may be constructed of rigid molded plastic tubing forming a frame, nylon netting and a support and anchoring device. The plastic tubing easily slides through tubes formed at the top and bottom of reinforced nylon netting. The horizontal tubes are joined together in the center with a "T" connector both at the top and bottom. Located in the center of the horizontal tubing you would connect a lateral rigid tubing to the "T" connections, thus giving it added support in the center of the guard. The frame is then connected to horseshoe shaped clamps at both ends. The bottom of the tubing frame lies flush to the top perimeter of the outer tub lip wall. There is a spring located within thehorseshoe shaped clamps. This allows the user to expand the horseshoe to the width of the outer tub lip wall. Upon release of the horseshoe, the spring retracts the horseshoe to the width of the tub lip wall securing the suction cups which are located at the bottom ends of the horseshoe clamps. This method would stabilize the mobility of the tub guard from both inside and outside of the tub. The nylon netting consists of a very close knit material. This will inhibit the change of the child getting their fingers caught, thus cutting off the circulation. The nylon netting is machine washable. Also, the tub guard can be quickly and easily removed when the bathtub is to be used.

Extension: Very similar to the assembly of the Tub Guard. The top frame end expands and attaches to the side wall or open end of the tub by a suction cup. The lower frame end is secured to the top of the tub wall by a suction cup attached to a 45° elbow fitting.

The invention may be used in situations where the tub enclosure is conventional and has three walls one at the back side of the tub and one at each end or in a situation where there is no wall at one or more of the ends of the tub.

For conventional enclosures the horseshoe shaped clamps provide support for the assembly across the entry side of the bathtub. The alternate embodiment is also able to be used in conventional enclosures where the support is provided by suction cups. The top frame member is attached to the end walls by suction cups and the lower frame member is attached to the top of the tub lip by suction cups.

In situations where the bathtub is configured without an enclosure wall at either or both ends another embodiment provides for support by use of a horseshoe shaped clamp at the entry side end of the bathtub end that does not have a wall and suction cups at the backside end of the bathtub end.

SUMMARY OF THE INVENTION

The apparatus disclosed in detail below is of a form that is both practical and economical in order to promote wide use. In addition to its preferred form, it may be made in an adjustable variation or in a kit form. It comprises a rectangular shaped netting with folded over edges, secured by means, to form tube like tunnels along the top and bottom edges, and a vertical fold at the center, secured by means, to also form a tube like tunnel (at the top and bottom of the center portion of the netting a portion of netting is cut out to allow members in the top and bottom tunnels to be joined to a member in the vertical tunnel). A frame of tubular members (top and bottom horizontal members, one vertical member and two T fittings) to support the netting and keep the netting stretched vertically and also as near as possible across the full width of the opening. And a horseshoe shaped spring loaded clamp support means.

The outer ends of the top and bottom horizontal members are used to join the frame to the support means. At the mid horizontal points of the top and bottom horizontal members, T fittings are used to join the mid vertical member to the top and bottom horizontal members. The support means used are two spring loaded horseshoe shaped clamps with suction cups, one situated at each lower horizontal end of the frame. In addition, the horizontal ends of the frame may have tubular extensions with suction cups for added strength and stability.

In a standard tub installation there would be a wall at each end of the tub to be available to prevent entry. In the event either or both walls do not exist an extension of the apparatus may be installed.

BRIEF DESCRIPTION OF THE DRAWINGS

The object and features of the invention may be understood with reference to the following detailed description of an illustrative embodiment of the invention, taken together with the accompanying drawings in which.

DESCRIPTION OF THE PREFERRED EMBODIMENT

Figure 1:
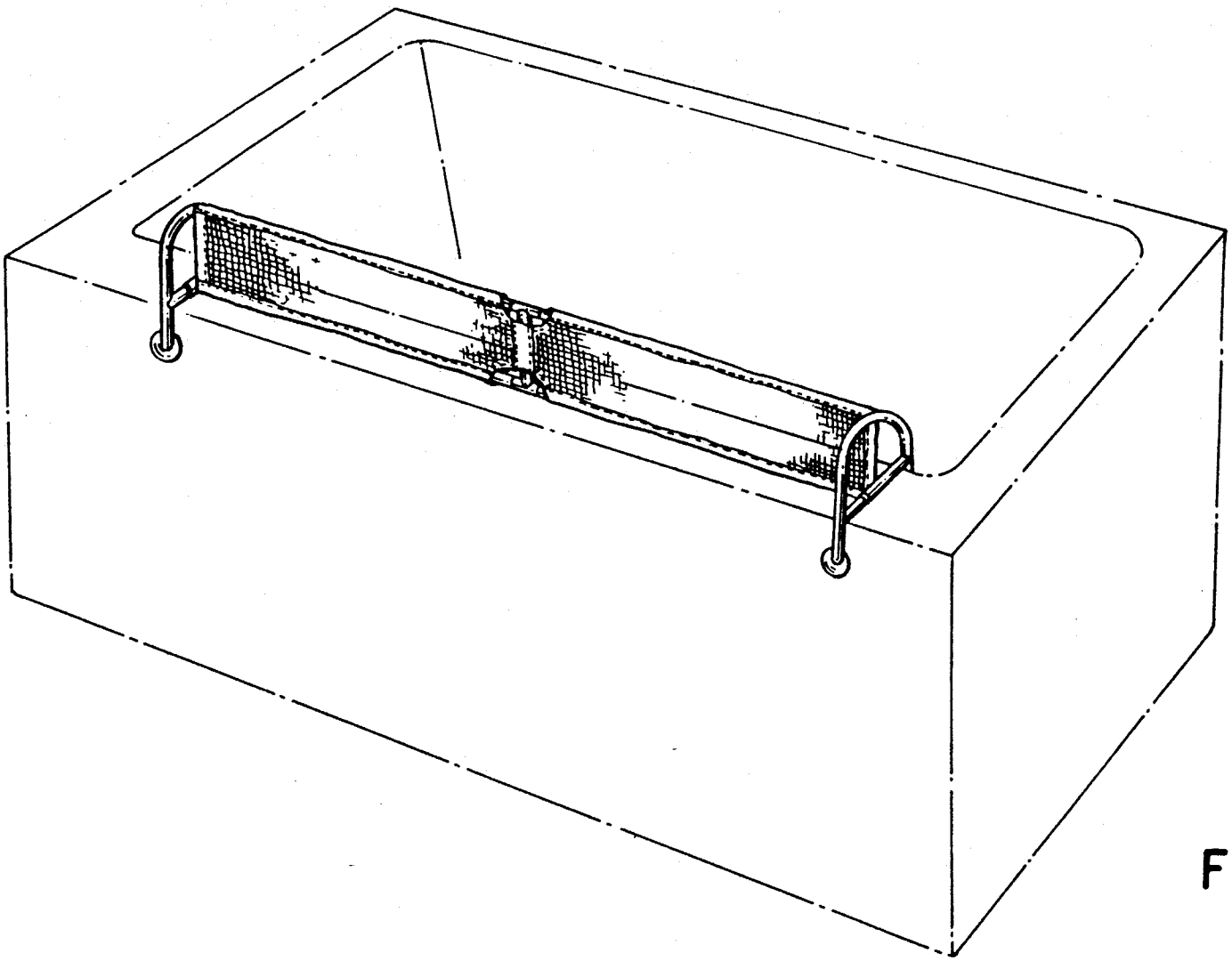
FIG. 1 illustrates a top perspective view of the apparatus indicating clamps as the support means, dotted lines indicating a tub.
Figure 2:
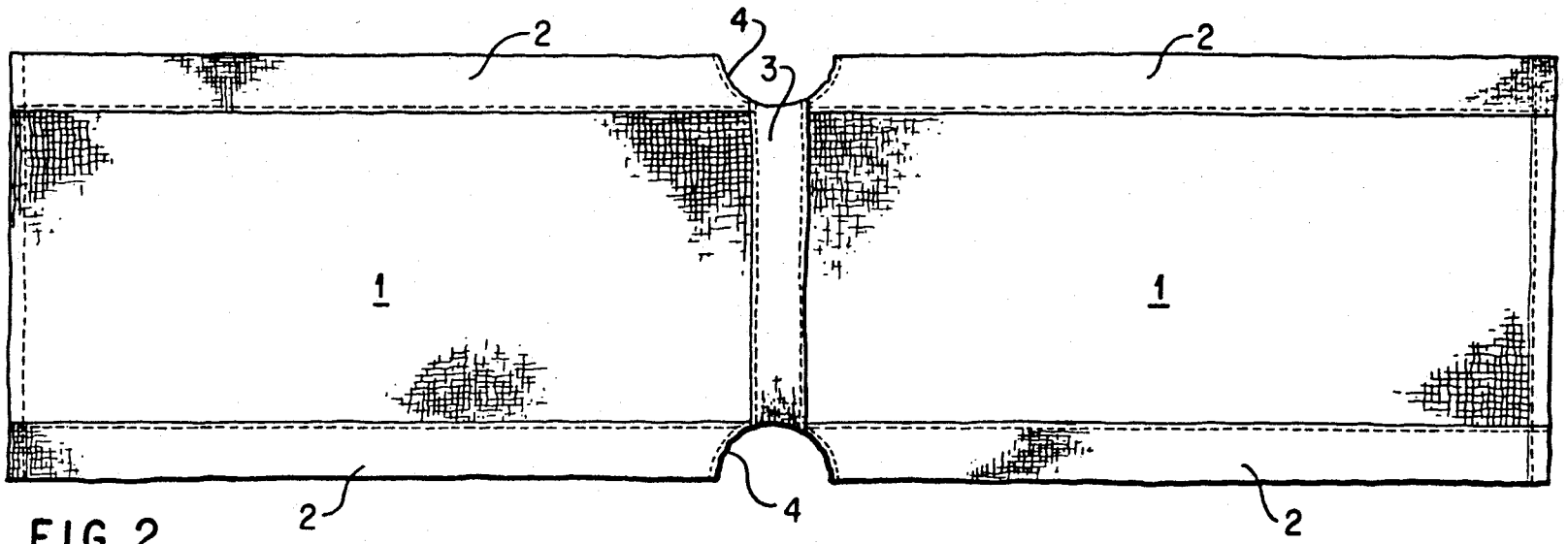
FIG. 2, 2A, 2B, and 2C illustrate a front view of the rectangular shaped netting (1), and component tubular members.
Figure 2A:
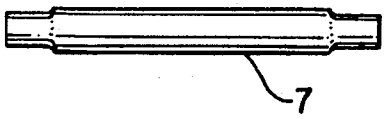
Figure 2B:
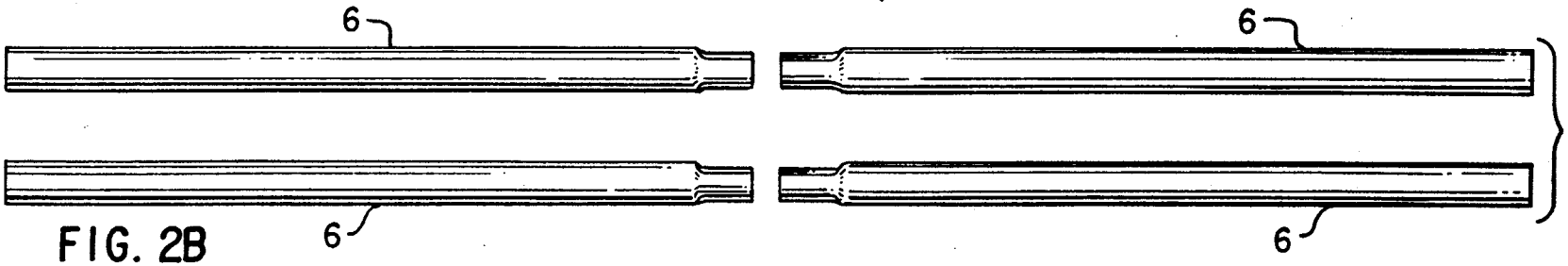
Figure 2C:
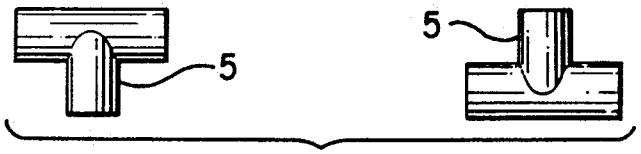
Figure 3A:
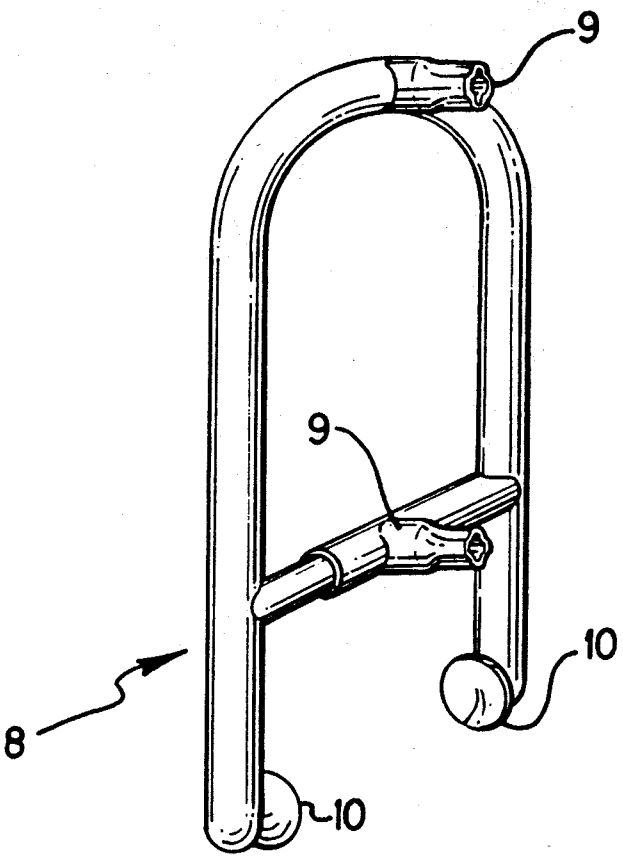
FIG. 3 and 3A of frame (5, 6, and 7) illustrate a front end view of the clamp (8) in a compressed state (3) and expanded state (3A), means to attach the tubular frame are indicated (9) and suction cups (10)
Figure 3:
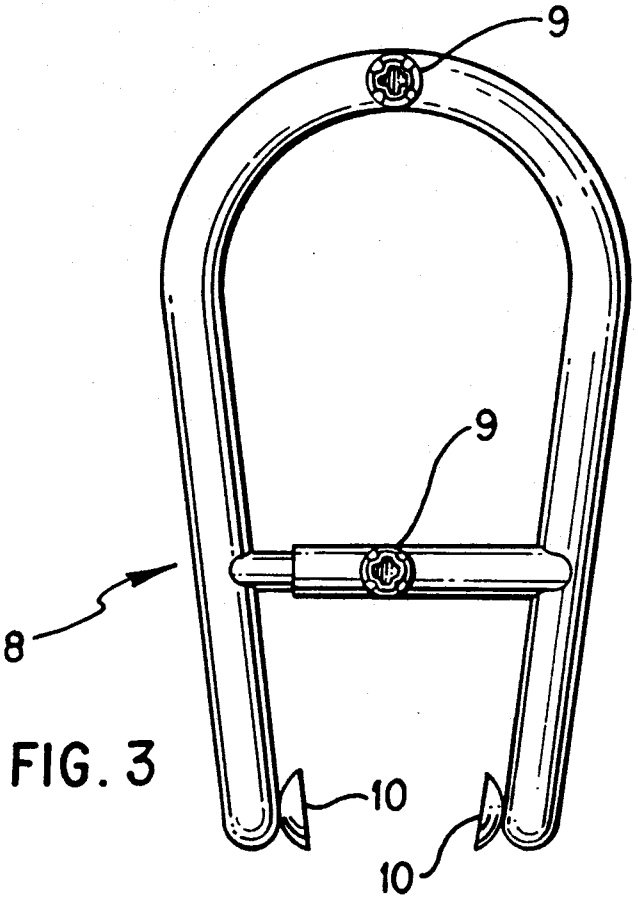

In FIG. 1 there is shown the Tub Guard and Extension apparatus of the present invention comprising a rectangular shaped netting FIG. 2 (1) with folded over edges, secured by means to form tube like tunnels along the top and bottom edges, (2) and a vertical fold at the center, secured by means, to form a similar tube like tunnel (3). At the top and bottom of the center portion of the netting a portion of netting is cut out (4) to allow the frame members (6 and 7) to be joined to other members or fittings (5). A frame is formed of the tubular members (top and bottom horizontal members (6) and one vertical member (7)) to support the netting and keep the netting stretched vertically and also as near as possible across the full width of the tub opening. Various fittings (5) and support means FIG. 3 (8) with connection posts (9) and suction cups (10) are used to secure the apparatus to the tub. This embodiment may be used whether or not the tub enclosure has walls at either or both ends of the tub.

Figure 4B:
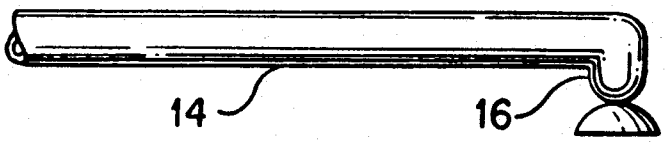
FIG. 4, 4A and 4B illustrate a front view of netting (11) and various component tubular members (13, 14, 15, and 16) for use in the extension.
Figure 4A:
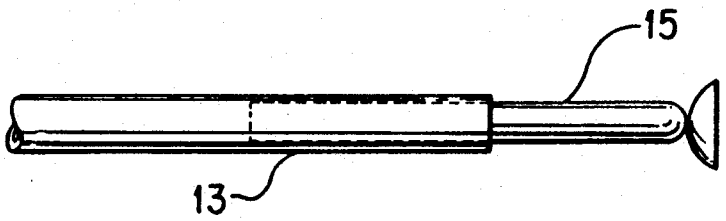
Figure 4:
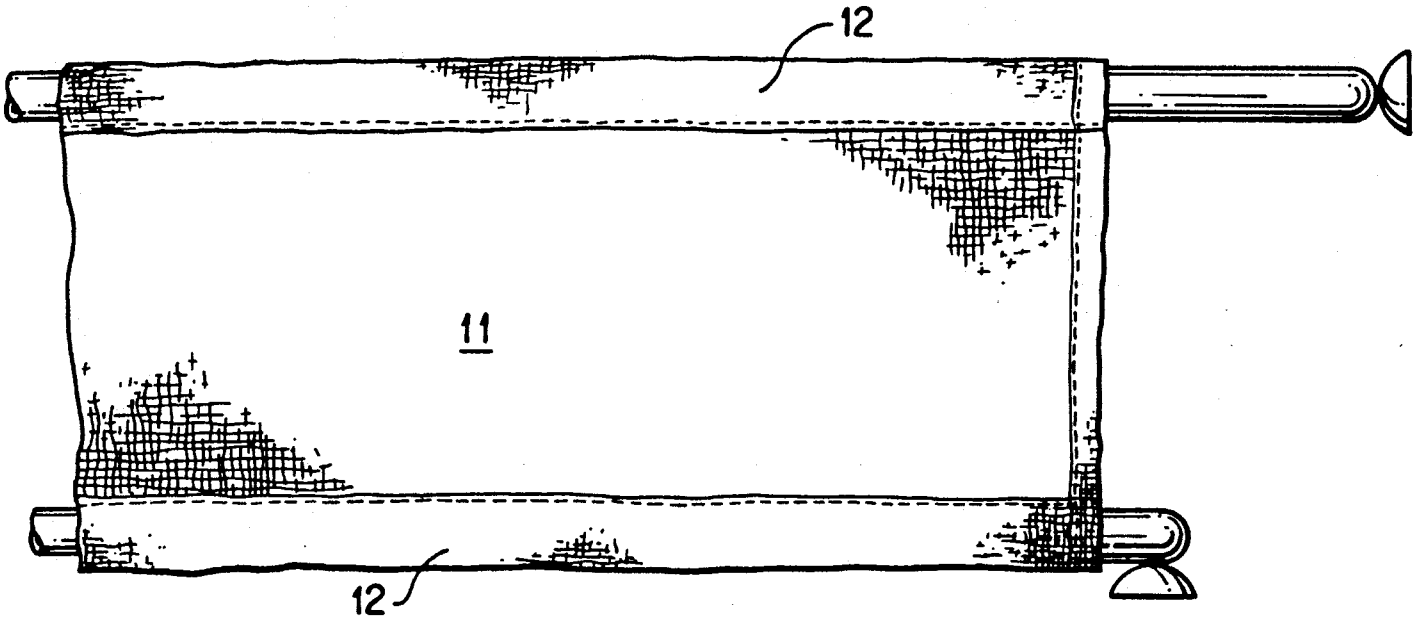

A second embodiment is shown in FIG. 4 where a rectangular shaped netting (11) with folded over edges is secured by means, to form tube like tunnels along the top and bottom edges (12). A frame is formed of tubular members (top horizontal members (13) and bottom horizontal member (14). The top horizontal member having slideable extensions (15) with suction cups at both ends to secure the frame to the bathtub enclosure walls. The bottom horizontal member may be shaped with elbows (16) and suction cups at both ends to secure the frame to the top of the bathtub. This embodiment may only be used for a conventional tub enclosure where there are walls at both ends of the bathtub.

In the event the tub installation does not have a wall at either or both ends to prevent entry an extension may be installed comprising a shorter version of the above described apparatus as shown in FIG. 4 comprising a rectangular shaped netting (11) with folded over edges, secured by means, to form tube like tunnels along the top and bottom edges (12). A frame is formed of tubular members (top horizontal members (13) and bottom horizontal member (14). The top horizontal member having a slideable extension (15) with suction cup to secure the frame to the bathtub back wall. The bottom horizontal member may be shaped with an elbow (16) and a suction cup to secure the frame to the top of the tub. Both the top and bottom horizontal members are secured to a support means (8) with connecting posts (9). Suction cups (10) on the support means are used to secure the extension to the end of the bathtub. The support means (8) is positioned to clamp to the end of the tub.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

What is claimed is:

1. Apparatus for preventing a toddler or infant from entering a bathtub, said bathtub having an entry side, a back side and two end sides, with enclosure walls at the back side and both end sides, the bathtub having a lip wall at the entry side, said apparatus comprising:

a rectangular shaped netting like material with folded over edges fixedly secured, to form tube like tunnels along the top and bottom edges, and a vertical fold fixedly secured, at the center to also form a tube like tunnel, a portion of the material being cut out at the top and bottom of the center portion;

a frame of tubular members including two top and two bottom horizontal members and one vertical member, slideably positioned within the tunnels in the netting like material to keep the material stretched across the entry side of the bathtub the top and bottom horizontal members each having a free end and a fixed end;

two tubular "T" fittings sized and shaped to joint the fixed ends of the horizontal members and the vertical member together to form an H positioned on its side; and a support means, said support means being two horseshoe shaped spring loaded clamps wherein the clamps are secured to the bathtub entry side lip wall by suction cups and said clamps are shaped to provide connecting posts sized to allow the free ends of the top and bottom horizontal members to be frictionally secured to said clamps.

2. An apparatus for preventing a toddler or infant from entering a bathtub, said bathtub having an entry side, a back side and two end sides the back side enclosed by a wall and one end side not enclosed by a wall, the bathtub having a lip wall at the entry side and also at the end not enclosed by a wall the lip walls both having an upper surface, said apparatus comprising:

rectangular shaped netting like material with folded over edges fixedly secured, to form tube like tunnels along the top and bottom edges;

tubular members including top and bottom horizontal members each having a first and second end, said horizontal members being slideably positioned in the additional netting tube like tunnels with the first ends being toward the entry side of said bathtub and the second ends being toward the back side of said bathtub;

a third tubular member with outer diameter sized to slideably fit within the second end of the top horizontal member with a front end and a rear end the front end begin within the top horizontal member and the rear end begin toward the back side of said bathtub;

an elbow fitting sized to be frictionally secured to the second end of the bottom horizontal member;

a support means, said support means being horseshoe shaped spring loaded clamp wherein the clamp is secured to the bathtub end side lip wall by suction cups and said clamp shaped to provide connecting posts sized to allow the first ends of the top and bottom horizontal members to be frictionally secured to said clamp; and two suction cups one secured to the rear end of the third tubular member to secure the member to the backside wall and one secured to the elbow fitting to secure the elbow fitting to the upper surface of the end side lip wall of said bathtub.

3. Apparatus for preventing a toddler or infant form entering a bathtub, said bathtub having an entry side, a back side and two end sides, with enclosure walls at the back side and at both end sides, the bathtub having a lip wall at the entry side the lip wall having an upper surface, said apparatus comprising:

a rectangular shaped netting like material with folded over edges fixedly secured, to form tube like tunnels along the top and bottom edges, and a vertical fold fixedly secured, at the center to also form a tube like tunnel, a portion of the material being cut out at the top and bottom of the center portion;

a frame of tubular members including two top and two bottom horizontal members and one vertical member, slideably positioned within the tunnels in the netting like material to keep the material stretched across the entry side of the bathtub the top and bottom horizontal members each having a free end and a fixed end;

two tubular "T" fittings sized and shaped to joint the fixed ends of the horizontal members and the vertical member together to form an H positioned on its side;

two tubular elbows sized and shaped to fit within the free ends of the bottom horizontal members; and a support means, said support means being two suction cups frictionally secured at the free ends of the top horizontal members whereby the apparatus is secured to the end walls and two suction cups frictionally secured at the tubular elbows whereby the apparatus is secured to the upper surface of the entry lip wall.

4. Apparatus according to claim 3, wherein said support means comprise:

two smaller tubular members with outer diameters sized, to slideably fit within the free end of the top horizontal members, each with a first end and a second end the first ends being within the free ends of the top horizontal members the second ends begin toward the end walls; and two suction cups fictionally secured at the second ends of the smaller tubular members whereby the apparatus is secured to the end walls and two suction cups frictionally secured a the tubular elbows whereby the apparatus is secured to the upper surface of the entry lip wall.

* * * * *